US007446469B2

(12) United States Patent
Lee

(10) Patent No.: US 7,446,469 B2
(45) Date of Patent: Nov. 4, 2008

(54) FLAT LAMP DEVICE WITH MULTI ELECTRON SOURCE ARRAY

(76) Inventor: Seung-Ho Lee, #435-702 Cheongmyung Village, Samsung Apt., 1046-1, Youngtong-dong, Youngtong-gu, Suwon-si, Gyeonggi-do (KR) 443-738

( * ) Notice: Subject to any disclaimer, the term of this patent is extended or adjusted under 35 U.S.C. 154(b) by 489 days.

(21) Appl. No.: 11/201,652

(22) Filed: Aug. 10, 2005

(65) Prior Publication Data

US 2006/0244357 A1 Nov. 2, 2006

(30) Foreign Application Priority Data

Apr. 28, 2005 (KR) ..... 10-2005-0035522

(51) Int. Cl.
*H01J 1/62* (2006.01)
*H01J 63/04* (2006.01)

(52) U.S. Cl. ..... 313/496; 313/495; 313/309; 313/310; 313/336; 313/351

(58) Field of Classification Search ..... 313/495–497, 313/336, 351, 346 R, 309–311
See application file for complete search history.

(56) References Cited

U.S. PATENT DOCUMENTS 6,933,664 B2 * 8/2005 Kitamura et al. ..... 313/309
7,161,285 B2 * 1/2007 Okamoto et al. ..... 313/311
2002/0079802 A1 * 6/2002 Inoue et al. ..... 313/309

* cited by examiner

*Primary Examiner*—Joseph L. Williams
*Assistant Examiner*—Kevin Quarterman
(74) *Attorney, Agent, or Firm*—Peter F. Corless; Edwards Angell Palmer & Dodge LLP

(57) ABSTRACT

A flat lamp device includes lower and upper glass plates facing each other in parallel; spacers interposed between the plates to keep a distance therebetween; a cathode electrode singly formed over the entire upper surface of the lower glass plate; an insulation film formed on the cathode electrode; semiconductor films independently patterned on the insulation at intervals; a catalyst metal layer laminated on a buffer metal layer to improve adhesive force of the catalyst metal formed on the semiconductor films; carbon nano-tubes formed on the catalyst metal layer; a grid electrode installed above the carbon nano-tubes between the plates to guide electron emission from the carbon nano-tubes with a mesh shape having an opening for passage of the emitted electrons; an anode electrode formed below the upper glass plate to accelerate the emitted electrons; and a fluorescent layer formed on a lower surface of the anode electrode.

10 Claims, 6 Drawing Sheets

FLAT LAMP DEVICE WITH MULTI ELECTRON SOURCE ARRAY

BACKGROUND OF THE INVENTION

1. Field of the Invention

The present invention relates to a flat lamp device, and more particularly to an improved flat lamp device capable of uniformly emitting light having high brightness with low energy consumption by adopting a plurality of electron sources having independent patterns.

2. Description of the Related Art

Generally, a flat display such as an LCD panel requires a separate backlight module in order to realize an image since it is not an active lamp device. Such a backlight module should form a flat light emission configuration so as to give uniform brightness over the entire area. In particular, as LCD panels get larger recently, the uniformity of brightness becomes more essential.

Conventionally, as a backlight source, there have been used a Cold Cathode Fluorescent Lamp (CCFL), an External Electrode Fluorescent Lamp (EEFL), a Light Emission Diode (LED), a Flat Fluorescent Lamp (FFL) and so on.

CCFL and EEFL using fluorescent lamps have properties of long life and excellent light emission efficiency, but they also show high energy consumption and high exothermic property. In addition, they have a limit in increasing their size, not suitable as a light source for a large-sized display. In addition, CCFL and EEFL are not friendly to environments due to the use of mercury.

Moreover, LED is excellent in realizing colors, but has drawbacks of low efficiency and expensive manufacture costs. FFL shows high brightness and excellent light efficiency, but it gives a relatively short long life cycle and insufficient for mass production. FFL also has a drawback of using mercury.

SUMMARY OF THE INVENTION

The present invention is designed in consideration of such problems of the prior art, and therefore it is an object of the present invention to provide a flat lamp device with excellent light emission uniformity so as to be used for a large-sized flat display or the like.

Another object of the present invention is to provide a flat lamp device that may give high brightness and relatively smaller exothermicity with low energy consumption.

Still another object of the present invention is to provide a flat lamp device with a structure capable to manufacture a slim display with a large size.

In order to accomplish the above objects, the present invention provides a flat lamp device, which includes a pair of lower and upper glass plates arranged to face each other in parallel; a plurality of spacers interposed between the lower and upper glass plates so as to keep a mutual distance therebetween; a cathode electrode formed in the form of a single layer over the entire area of an upper surface of the lower glass plate; an insulation film formed on an upper surface of the cathode electrode; a plurality of semiconductor films independently patterned on the insulation film and spaced apart from each other at predetermined intervals; a catalyst metal layer laminated on the buffer metal; a buffer metal interposed between the semiconductor films and the buffer metal layer to improve adhesive force of the catalyst metal layer; a plurality of carbon nano-tubes formed on the catalyst metal layer; a grid electrode installed above the carbon nano-tubes between the lower and upper glass plates so as to guide electron emission from the carbon nano-tubes, the grid electrode having a mesh shape with an opening through which the emitted electrons pass; a transparent anode electrode formed on a lower surface of the upper glass plate so as to accelerate the electrons emitted from the carbon nano-tubes; and a fluorescent layer formed on a lower surface of the anode electrode so that the accelerated electrons are collided thereto to emit light.

In another aspect of the present invention, there is also provided a flat lamp device, which includes a pair of lower and upper glass plates arranged to face each other in parallel; a plurality of spacers interposed between the lower and upper glass plates so as to keep a mutual distance therebetween; a cathode electrode formed in the form of a single layer over the entire area of an upper surface of the lower glass plate; a plurality of insulation films independently patterned on an upper surface of the cathode electrode and spaced apart from each other at predetermined intervals; a plurality of semiconductor films independently patterned on the insulation film; a catalyst metal layer laminated on the buffer metal; a buffer metal interposed between the semiconductor films and the buffer metal layer to improve adhesive force of the catalyst metal layer; a plurality of carbon nano-tubes formed on the catalyst metal layer; a grid electrode installed above the carbon nano-tubes between the lower and upper glass plates so as to guide electron emission from the carbon nano-tubes, the grid electrode having a mesh shape with an opening through which the emitted electrons pass; a transplant anode electrode formed on a lower surface of the upper glass plate so as to accelerate the electrons emitted from the carbon nano-tubes; and a fluorescent layer formed on a lower surface of the anode electrode so that the accelerated electrons are collided thereto to emit light.

Preferably, the grid electrode has 50% or more aperture ratio.

In addition, a light emission improving film may be further attached to an upper surface of the upper glass plate so as to improve light emission uniformity of the emitted light.

Preferably, the spacers are integrally formed with the grid electrode.

Preferably, the catalyst metal layer is formed using any of Ni, Co, Fe and their alloys.

More preferably, a buffer metal layer is further interposed between the catalyst metal layer and the semiconductor films so as to improve adhesive force of the catalyst metal layer, and the buffer metal layer is formed using any of Ti, TiN, Ta, TaN, WNx and TiW.

According to the present invention, the anode electrode is formed using transparent electrode material containing InSnOx, InOx or ZnOx.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Hereinafter, preferred embodiments of the present invention will be described in detail with reference to the accompanying drawings. Prior to the description, it should be understood that the terms used in the specification and appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Figure 1:
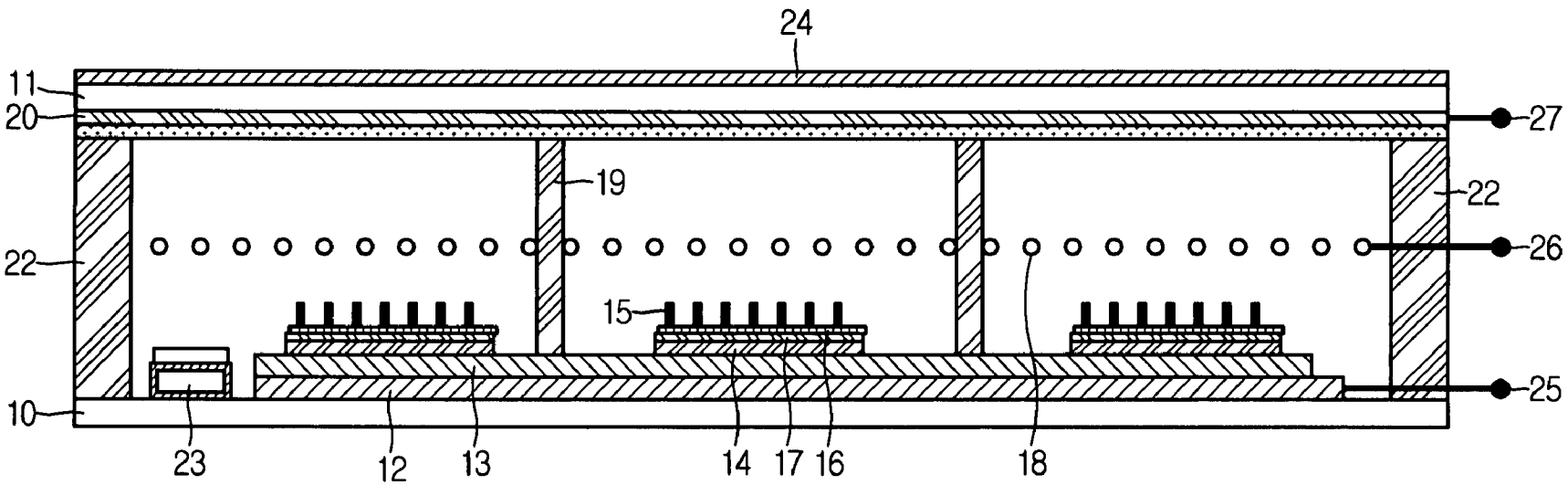
FIG. 1 is a sectional view schematically showing a flat lamp device according to a preferred embodiment of the present invention.

A flat lamp device of the present invention may be used as a backlight module of an LCD panel. FIG. 1 is a sectional view showing the flat lamp device according to a preferred embodiment of the present invention.

Referring to FIG. 1, the flat lamp device of the present invention includes a pair of lower and upper glass plates 10 and 11 arranged in parallel to face each other at a predetermined interval.

Figure 2:
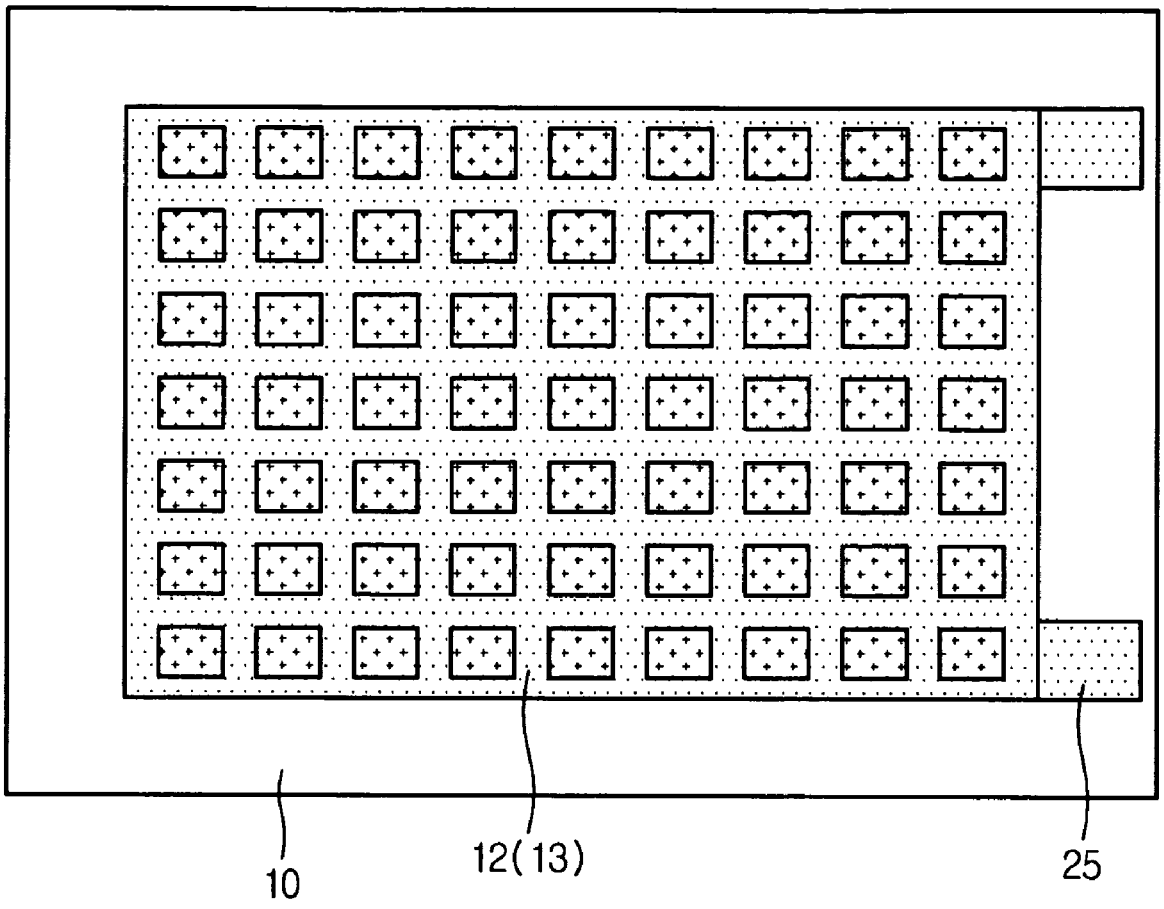
FIG. 2 is a plane view schematically showing a lower glass plate and an electron source of the flat lamp device according to the preferred embodiment of the present invention.

A cathode electrode 12 is formed on the lower glass plate 10. As shown in FIG. 2, the cathode electrode 12 is a single layer formed over the entire area of the surface of the lower glass plate 10.

In this embodiment, a plurality of electron sources formed independently are formed on cathode electrode 12. These electron sources have a plurality of carbon nano-tubes that emit electrons.

Specifically, an insulation film 13 and a semiconductor film 14 are formed on the upper surface of the cathode electrode 12 in order to keep electron emission of the carbon nano-tubes uniformly.

The insulation film 13 plays a role of a barrier for controlling flow of electrons so as to improve uniformity of electron emission and a role of shielding the cathode electrode. Preferably, the insulation film 13 is made of SiNx and has a thickness of about 50 nm or below.

The semiconductor film 14 is also used to improve uniformity of electron emission. Preferably, the semiconductor film 14 is made of amorphous silicon, and poly Si, and has a thickness of about 200 nm or below.

In this embodiment, the semiconductor film 14 formed on the insulation film 13 is composed of a plurality of semiconductor films independently patterned at predetermined intervals.

Figure 5:
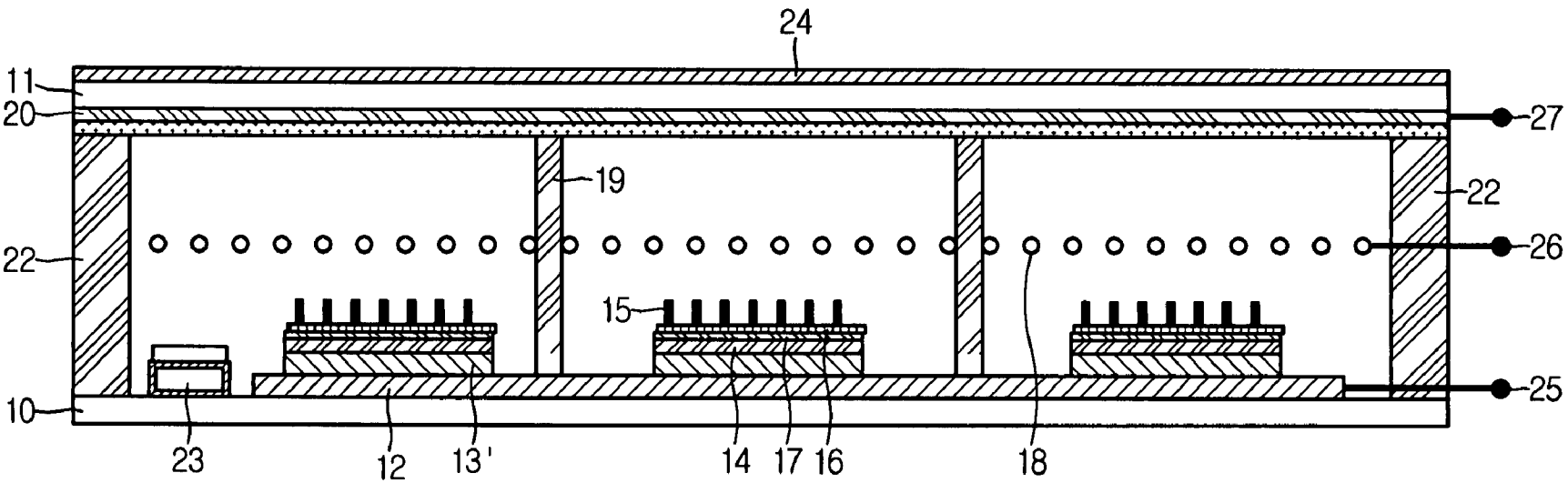
FIG. 5 is a sectional view schematically showing a flat lamp device according to another embodiment of the present invention.

In addition, the insulation film 13 is a single film formed over the entire area on the cathode electrode 12. As an alternative, as shown in FIG. 5, the insulation film may be composed of a plurality of insulation films 13' independently patterned at predetermined intervals so as to be formed only within the area where the semiconductor film 14 is formed.

A plurality of carbon nano-tubes 15 are formed on the semiconductor film 14 in the present invention. For the growth of these carbon nano-tubes 15, a catalyst metal layer 16 is laminated on the semiconductor film 14. Preferably, the catalyst metal layer 16 is made of Ni, Co, Fe or their alloys, and a buffer metal layer 17 is made of Ti, TiN, Ta, TaN, WNx or TiW and is interposed between the catalyst metal layer 16 and the semiconductor film 14 in order to improve the adhesive force of the catalyst metal layer 16.

Though not illustrated in detail, the insulation film 13, the semiconductor film 14 and the catalyst metal layer 16 may be formed using the existing semiconductor manufacturing process using photolithography, screen-printing or ink-jet method. In addition, the carbon nano-tubes 15 may be provided using various ways such as the chemical vapor deposition utilizing plasma or the screen printing method that uses solvent and adhesive to be adhered in mixture.

Figure 3:
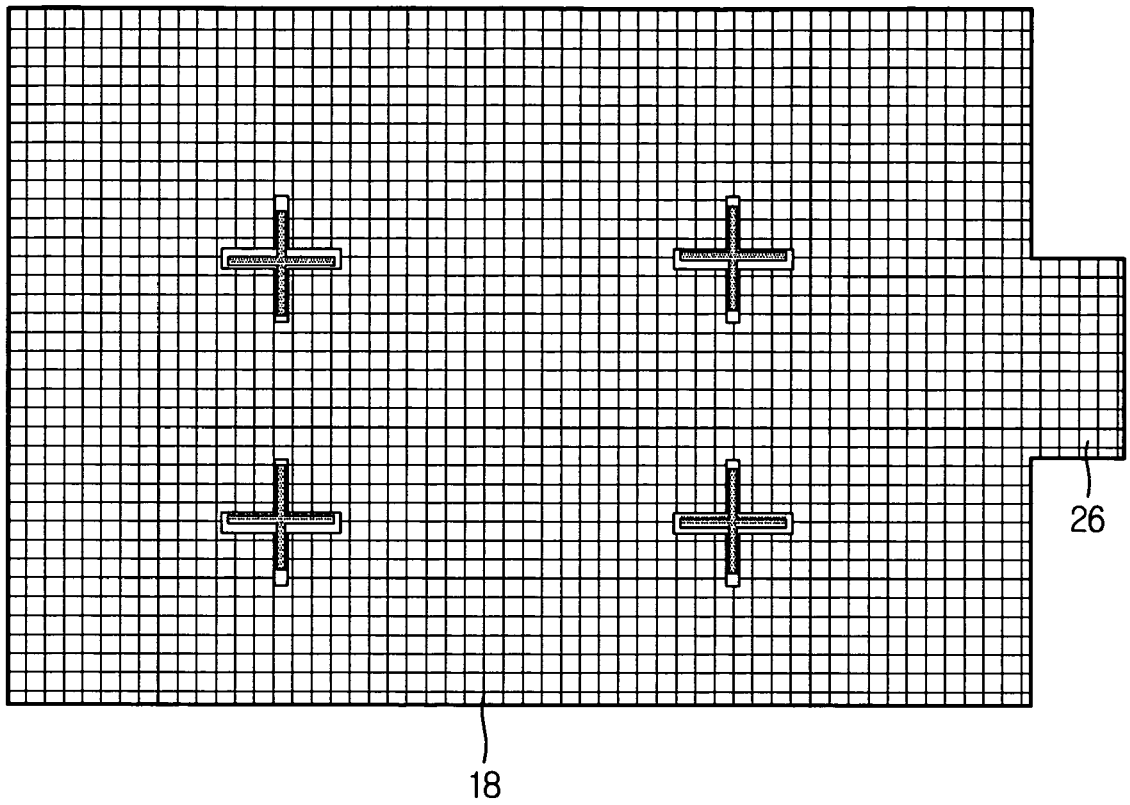
FIG. 3 is a plane view schematically showing a grid electrode and a spacer of the flat lamp device according to the preferred embodiment of the present invention.

On the upper surface of the cathode electrode 12 on which the carbon nano-tubes 15 are formed as mentioned above, a grid electrode 18 is installed in order to guide electron emission from the carbon nano-tubes 15. The grid electrode 18 is formed in a mesh shape with an opening, preferably having a 50% or more aperture ratio, so that electrons emitted from the carbon nano-tubes 15 may pass through it, as shown in FIG. 3. More preferably, the grid electrode 18 is installed to be spaced apart from the cathode electrode 12 by a distance of 0.1 to 10 mm.

In addition, a plurality of spacers 19 are interposed between the lower and upper glass plates 10 and 11 facing each other so as to keep the mutual distance between them. More preferably, the spacers 19 are integrally formed with the grid electrode 18 to facilitate their fabrication as shown in FIG. 3.

Figure 4:
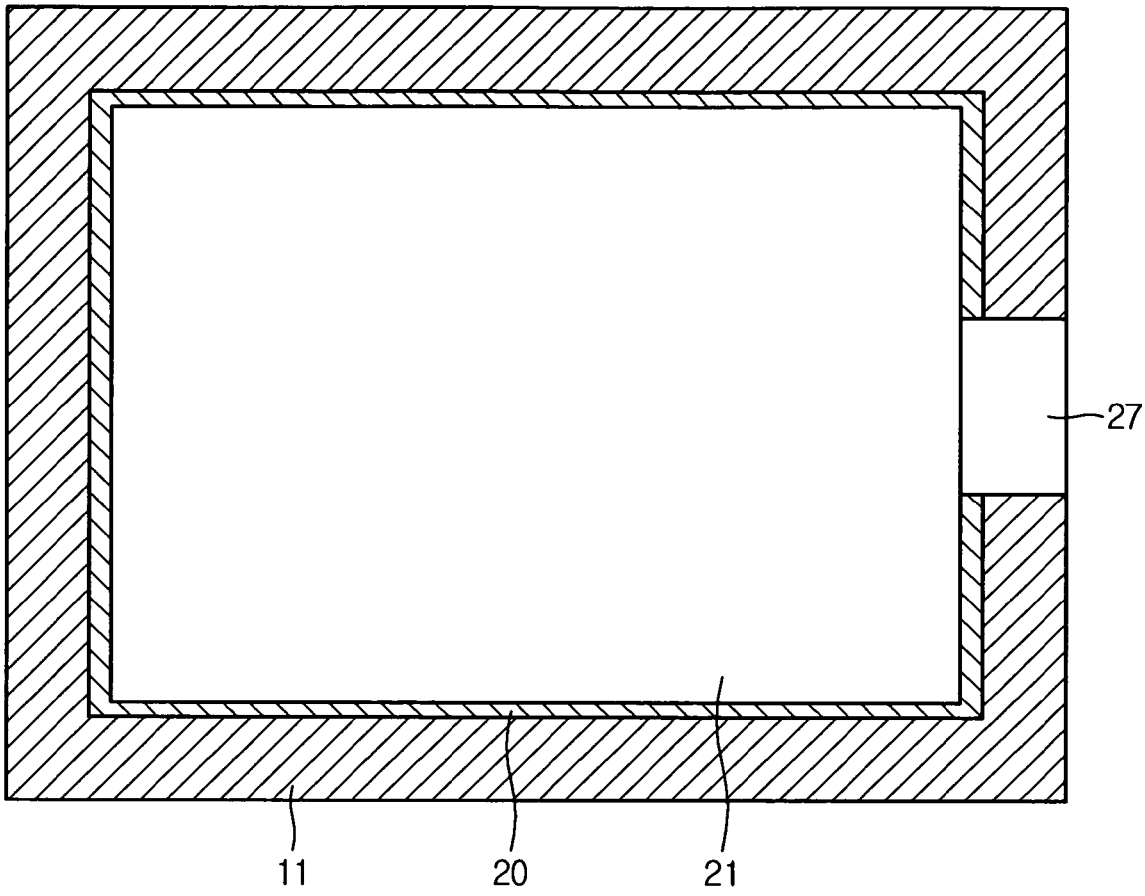
FIG. 4 is a bottom view schematically showing an upper glass plate, an anode electrode and a fluorescent layer of the flat lamp device according to the preferred embodiment of the present invention.

On the lower surface of the upper glass plate 11, preferably at a point spaced apart from the grid 18 by a distance of 1 to 1000 mm, an anode electrode 20 is formed over the entire area thereof, as shown in FIG. 4. The anode electrode 20 is made of transparent electrode material such as InSnOx, InOx, ZnOx or InZnOx.

On the lower surface of the anode electrode 20, a fluorescent layer 21 is provided so that electrons emitted from the carbon nano-tubes 15 may collide thereto to emit light. The fluorescent layer 21 contains fluorescent material that mainly includes sulfide or oxide, and the fluorescent material may be selected to emit white, green, blue, red or other colors according to its usage.

Frits 22 are attached to edges of the lower and upper glass plates 10 and 11, and then heated and melted under the vacuum environment so as to unite the lower plate 10 and the upper plate 11. The frits 22 are composed of combination of adhesive material having a lower melting point than that of the glass plate and spacers (not shown) that compose a support.

Preferably, prior to uniting the plates, a getter 23 is inserted therein, and then after the plates are united, the getter 23 is activated by laser to capture the residual gas therein and improve the vacuum level.

In addition, a light emission improving film 24 may be further attached on the upper surface of the glass substrate 11 so as to obtain uniform light emission.

In the drawings, reference numerals 25, 26 and 27 designate pads for applying voltage to the cathode electrode 12, the grid electrode 18 and the anode electrode 20 respectively.

Now, operation of the flat lamp device according to the preferred embodiment of the present invention, which has a configuration as described above, is described.

In order to operate the flat lamp device of the present invention, voltage is applied to the cathode electrode 12 and the grid electrode 18. Preferably, the applied voltage is a positive voltage less than 100V on the basis of the cathode electrode 12.

If the voltage is applied as mentioned above, electrons are emitted from the carbon nano-tubes 15.

At this time, a high voltage is applied to the anode electrode 20 so as to accelerate the electrons emitted from the carbon nano-tubes 15 toward the fluorescent layer 21. Then, the accelerated electrons collide with the fluorescent layer 21, and the fluorescent material thus emits and irradiates light.

Luminous intensity of the irradiated light may be adjusted by controlling voltage difference between the grid electrode 18 and the cathode electrode 12 and voltage difference between the cathode electrode 12 and the anode electrode 20.

The light emitted from the fluorescent layer 21 is emitted to the front through the upper glass plate 11, and it becomes irradiated more uniformly as it passes through the light emission improving film 18.

Figure 6:
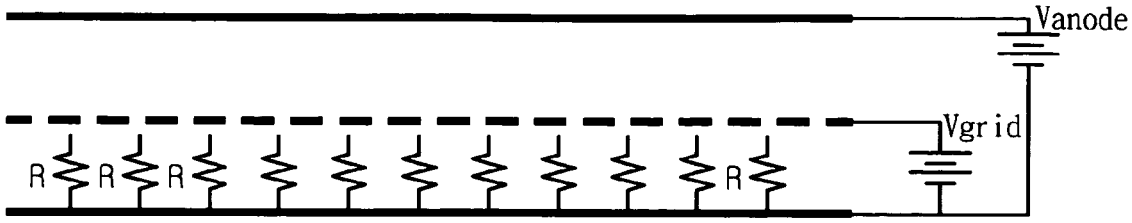
FIG. 6 is a circuit diagram of the flat lamp device according to the preferred embodiment of the present invention.

The circuit diagram of the flat lamp device according to the present invention may be expressed as shown in FIG. 6. Referring to FIG. 6, the flat lamp device of the present invention may include the grid electrode 18 for guiding electron emission from electron emission units of the carbon nano-tubes 15, between the cathode electrode 12 and the anode electrode 20, to guide the electron emission with low voltage. In addition, since a plurality of electron emission units are configured as a parallel circuit and operated independently, it is possible to minimize interactions which arise among the electron emission units.

Adoption of such a grid electrode and configuration of parallel circuit of the electron emission units enable stable operation of a plane light source and ensure uniform plane light emission.

APPLICABILITY TO THE INDUSTRY

The flat lamp device of the present invention may guide uniform electron emission over a large area by means of a plurality of independent electron sources on which the carbon nano-tubes are formed, accordingly obtaining uniform light distribution. If necessary, the flat lamp device may be provided with a light source that gives desired brightness by setting the number, distribution pattern and size of the electron sources in a suitable manner.

In addition, the flat lamp device of the present invention excites fluorescent material by means of electrons to emit light, causing less exothermicity than the conventional fluorescent lamps.

Moreover, the flat lamp device of the present invention has an effect of reducing energy consumption due to high voltage since it may obtain many electrons from a plurality of the carbon nano-tubes.

The flat lamp device of the present invention may be used for a backlight of a passive display device such as LED panels, and it may be used as a separate light source by itself.

What is claimed is:

1. A flat lamp device, comprising:

a pair of lower and upper glass plates arranged to face each other in parallel;

a plurality of spacers interposed between the lower and upper glass plates so as to keep a mutual distance therebetween;

a cathode electrode formed in the form of a single layer over the entire area of an upper surface of the lower glass plate;

an insulation film formed on an upper surface of the cathode electrode;

a plurality of semiconductor films independently patterned on the insulation film and spaced apart from each other at predetermined intervals;

a catalyst metal layer laminated on the semiconductor films;

a buffer metal layer interposed between the catalyst metal layer and the semiconductor films to improve adhesive force of the catalyst metal layer;

a plurality of carbon nano-tubes formed on the catalyst metal layer;

a grid electrode installed above the carbon nano-tubes between the lower and upper glass plates so as to guide electron emission from the carbon nano-tubes, the grid electrode having a mesh shape with an opening through which the emitted electrons pass;

an anode electrode formed on a lower surface of the upper glass plate so as to accelerate the electrons emitted from the carbon nano-tubes; and a fluorescent layer formed on a lower surface of the anode electrode so that the accelerated electrons are collided thereto to emit light.

2. The flat lamp device according to claim 1, wherein the grid electrode has 50% or more aperture ratio.

3. The flat lamp device according to claim 1, wherein a light emission improving film is further attached to an upper surface of the upper glass plate so as to improve light emission uniformity of the emitted light.

4. The flat lamp device according to claim 1, wherein the spacers are integrally formed with the grid electrode.

5. The flat lamp device according to claim 1, wherein the catalyst metal layer is formed using any of Ni, Go, Fe and their alloys.

6. A flat lamp device, comprising:

a pair of lower and upper glass plates arranged to face each other in parallel;

a plurality of spacers interposed between the lower and upper glass plates so as to keep a mutual distance therebetween;

a cathode electrode formed in the form of a single layer over the entire area of an upper surface of the lower glass plate;

a plurality of insulation films independently patterned on an upper surface of the cathode electrode and spaced apart from each other at predetermined intervals;

a plurality of semiconductor films independently patterned on the insulation film;

a catalyst metal layer laminated on the semiconductor films;

a buffer metal layer interposed between the catalyst metal layer and the semiconductor films to improve adhesive force of the catalyst metal layer;

a plurality of carbon nano-tubes formed on the catalyst metal layer;

a grid electrode installed above the carbon nano-tubes between the lower and upper glass plates so as to guide electron emission from the carbon nano-tubes, the grid electrode having a mesh shape with an opening through which the emitted electrons pass;

an anode electrode formed on a lower surface of the upper glass plate so as to accelerate the electrons emitted from the carbon nano-tubes; and a fluorescent layer formed on a lower surface of the anode electrode so that the accelerated electrons are collided thereto to emit light.

7. The flat lamp device according to claim 6, wherein the grid electrode has 50% or more aperture ratio.

8. The flat lamp device according to claim 6, wherein a light emission improving film is further attached to an upper surface of the upper glass plate so as to improve light emission uniformity of the emitted light.

9. The flat lamp device according to claim 6, wherein the spacers are integrally formed with the grid electrode.

10. The flat lamp device according to claim 6, wherein the catalyst metal layer is formed using any of Ni, Co, Fe and their alloys.

* * * * *